United States Patent [19]

Robinson et al.

[11] Patent Number: 5,007,440

[45] Date of Patent: Apr. 16, 1991

[54] PROCESS FOR PROVIDING SMOKABLE MATERIAL

[75] Inventors: Amy L. Robinson, Winston-Salem; Chandra K. Banerjee, Pfafftown, both of N.C.

[73] Assignee: R. J. Reynolds Tobacco Company, Winston-Salem, N.C.

[21] Appl. No.: 436,409

[22] Filed: Nov. 14, 1989

[51] Int. Cl.[5] ..... A24D 1/18

[52] U.S. Cl. ..... 131/369; 131/359; 131/370; 131/372; 131/375

[58] Field of Search ..... 131/359, 369, 353, 355, 131/370, 372, 375

[56] References Cited

U.S. PATENT DOCUMENTS

| | | | |
|---|---|---|---|
| 3,364,935 | 1/1968 | Moshy et al. . | |
| 3,613,693 | 10/1971 | Monte . | |
| 3,746,012 | 7/1973 | Deszyck . | |
| 3,795,250 | 3/1974 | Halter . | |
| 3,885,574 | 5/1975 | Borthwick et al. . | |
| 3,931,824 | 1/1976 | Miano et al. . | |
| 4,079,742 | 3/1978 | Rainer et al. . | |
| 4,109,664 | 8/1978 | Hedge | 131/359 |
| 4,233,993 | 11/1980 | Miano et al. | 131/359 |
| 4,674,519 | 6/1987 | Keritsis et al. . | |
| 4,874,000 | 10/1989 | Tamol et al. . | |

FOREIGN PATENT DOCUMENTS

| | | |
|---|---|---|
| 236992 | 9/1987 | European Pat. Off. . |
| 1013303 | 12/1965 | United Kingdom . |

*Primary Examiner*—V. Millin

[57] ABSTRACT

Processed smokable materials are provided by forming a slurry of combustible material (e.g., a carbonaceous material) in an aqueous liquid. The slurry then is contacted with a foaming agent which includes a mixture of a surfactant and a polymeric film-forming agent. The slurry is agitated to provide a slurry of decreased density. The slurry so provided then is formed into the desired shape and dried. The processed smokable material which results is useful as cut filler for cigarette manufacture.

22 Claims, 1 Drawing Sheet

PROCESS FOR PROVIDING SMOKABLE MATERIAL

BACKGROUND OF THE INVENTION

The present invention relates to smokable materials for smoking articles such as cigarettes, and in particular, to processes for manufacturing smokable materials.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a smokable rod. It has become desirable to manufacture a cigarette having a cylindrical filter element aligned in an end-to-end relationship with the smokable rod. Typically, a filter element includes cellulose acetate tow circumscribed by plug wrap, and is attached to the smokable rod using a circumscribing tipping material.

Various processed smokable materials are known. For example, numerous reconstituted tobacco materials are employed as components of a blend of tobacco materials within a cigarette. Smokable materials having the tradenames Cytrel and NSM were introduced in Europe during the 1970's. A substantial listing of smokable materials can be found in U.S. Pat. No. 4,079,742 to Rainer et al.

It would be highly desirable to provide a process for manufacturing processed smokable materials.

SUMMARY OF THE INVENTION

The present invention relates to a process for providing a smokable material. The process involves providing a slurry of combustible material (e.g., a pyrolyzed cellulosic material) within an aqueous liquid. The slurry preferably includes a binding agent, and also an inorganic filler material. The slurry so provided then is contacted with a foaming agent. The foaming agent includes an intimate mixture of surfactant and polymeric film-forming agent. The preferred foaming agent is an admixture of surfactant, polymeric film-forming agent and aqueous liquid. The slurry and foaming agent so contacted are subjected to conditions sufficient to provide a slurry of decreased density. For example, the slurry and foaming agent are subjected to shear agitation as the slurry and foaming agent are contacted. The slurry of decreased density then is formed into the desired or predetermined shape and dried to form a smokable material. For example, the slurry is cast as a sheet, and dried. The smokable material which results then can be employed in the manufacture of smoking articles, such as cigarettes.

DETAILED DESCRIPTION OF THE PREFERRED EMBODIMENTS

Figure 1:
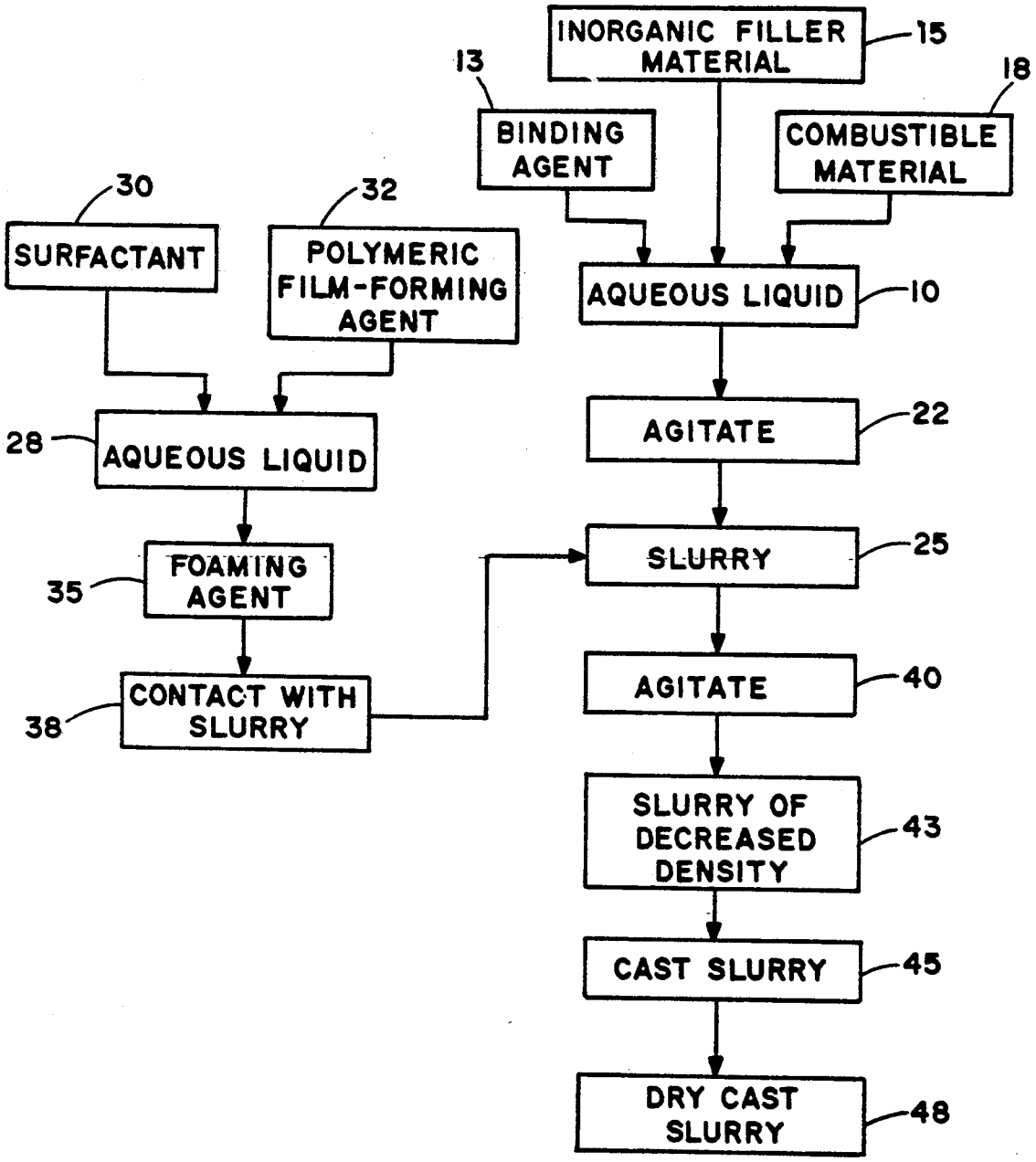
FIG. 1 is a schematic diagram of the process steps representative of one embodiment of the present invention.

Referring to FIG. 1, an aqueous liquid 10 has binding agent 13, inorganic filler material 15 and combustible material 18 charged therein. The resulting mixture of liquid, binding agent, inorganic filler material and combustible material is agitated 22 in order to provide a slurry 25 of a relatively thick consistency. Into an aqueous liquid 28 is charged a surfactant 30 and a polymeric film-forming agent 32 in order to provide a foaming agent 35. The foaming agent is charged 38 into the slurry 25 while the slurry is agitated 40, in order to provide a slurry of decreased density 43. The decreased density slurry 43 is cast 45 as a sheet, and dried 48. The cast material can be dried at ambient temperatures or at elevated temperatures. The resulting dried sheet can be cut or broken into "strip" form, and later can be cut or shredded into cut filler form.

The foaming agent includes a surfactant. The surfactant can be anionic, cationic or nonionic in character. The surfactant is a surface-active agent which reduces the surface tension of a liquid, and hence promotes the formation of gas bubbles within the liquid. Examples of suitable surfactants include sodium lauryl sulfate, surfactants available as Katapol from GAF Inc., polyoxyethylene ethers available as Brij from Sigma Chemical Co., and polyoxyethylene sorbitans available as Tween from Sigma Chemical Co. Mixtures of two or more surface active agents can be employed.

The foaming agent includes a polymeric film-forming agent. Such an agent exhibits interbonding capabilities. Examples of polymeric film-forming materials include guar gum, methylcellulose, carboxymethylcellulose, and hydroxypropyl methylcellulose.

The foaming agent preferably includes an aqueous liquid. Such a liquid consists primarily of water, preferably greater than about 90 weight percent water, and can be essentially pure water. The aqueous liquid can be a co-solvent mixture, such as a mixture of water and one or more solvents which are miscible therewith. An example of a co-solvent mixture is a solvent consisting of 95 weight parts water and 5 weight parts ethanol. Examples of essentially pure water are tap water, deionized water and distilled water.

The foaming agent includes an intimate mixture of the surfactant, polymeric film-forming agent and the preferred aqueous liquid. Such a mixture normally includes about 50 to about 80 percent surfactant and about 20 to about 50 percent polymeric film-forming agent, based on the total weight of the surfactant and polymeric film-forming agent. When water is incorporated into the foaming agent mixture, the resulting mixture normally includes greater than about 98 percent aqueous liquid, based on the total weight of that mixture.

The smokable materials preferably incorporate carbonaceous material (i.e., a material consisting primarily of carbon) therein. Such a material is a combustible material, and most preferably is derived from natural cellulosic materials. Natural cellulosic materials preferably have a high cellulose content (i.e., a cellulose content above about 80 weight percent). Examples of natural cellulosic materials include cotton fibers, cotton linters, hardwood pulp and softwood pulp. Highly preferred cellulosic materials have a high alpha-cellulose content. Typical combustible carbonaceous materials are provided by pyrolyzing a natural cellulosic material under inert atmosphere at temperatures between about 600° C. and about 1,200° C. Such carbonaceous materials normally exhibit a surface area of less than about 500 $m^2/g$, as determined using the Dubinin-Polanyi method described by Lamond and Marsh, Carbon, Vol. 1, p. 281 and p. 293 (1964). Such carbonaceous materials can be activated in an oxidizing environment (e.g., under carbon dioxide or steam) to increase the surface area and/or porosity thereof). Preferred combustible carbonaceous materials include at least about 80 weight percent carbon.

The smokable materials most preferably include some form of tobacco material incorporated therein. The tobacco material normally has a combustible form or the form of an extract. Combustible tobacco materials have the form of tobacco dust, tobacco fines, tobacco laminae, tobacco stem, processed tobacco filler (e.g., volume expanded tobacco or reconstituted tobacco), or the like. Tobacco extracts are provided by extracting a tobacco material using a solvent such as water, carbon dioxide, a hydrocarbon, or a halocarbon, as well as various other organic and inorganic solvents. Tobacco extracts can include spray dried extracts; tobacco essences, such as those essences described in European Patent Application No. 326,370; and aroma oils and extracts described in U.S. Pat. No. 4,506,682 to Mueller and U.S. patent application Ser. No. 310,413, filed Feb. 13, 1989.

The smokable materials preferably incorporate a binding agent. Examples of suitable binding agents include hydroxypropylcellulose such as Klucel H from Aqualon Co.; hydroxypropyl-methylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and carboxymethylcellulose such as CMC 7HF and CMC 7H4F from Hercules Inc. Other binding agents include corn starch, guar gum, locust bean gum, pectins and alginates. Combinations or blends of binding agents (e.g., a mixture of guar gum and locust bean gum) can be employed.

The preferred smokable materials incorporate at least one inorganic filler material therein. Typical inorganic filler materials can have a fibrous, flake, crystalline, hollow or particulate form. Examples of inorganic filler material include calcium carbonate, calcium sulfate, magnesium oxide, magnesium hydroxide, perlite, synthetic mica, vermiculite, clays, thermally stable carbon fibers, zinc oxide, dawsonite, low density hollow spheres of calcium carbonate, glass spheres, glass bubbles, thermally stable carbon microspheres, calcium sulphate fibers, hollow ceramic microspheres, alumina, and the like. Desirable inorganic materials exhibit a bulk density below about 2 g/cm$^3$, more preferably below about 1 g/cm$^3$. One inorganic material has the form of glass bubbles which are available as Code 25P35 from Potter's Industries. Another inorganic material is available as Extendospheres XOL-200 from PQ Corp.

One desirable inorganic filler material has the form of an agglomerated matrix of inorganic material. A particularly desirable inorganic filler material is agglomerated calcium carbonate, and preferably, agglomerated precipitated calcium carbonate. Such materials are prepared by providing an aqueous slurry of calcium carbonate particles and a binding material, and drying the slurry to form an agglomerated matrix of calcium carbonate (i.e., a matrix of a plurality of calcium carbonate particles spaced within a continuous or semi-continuous phase of binding agent). Calcium carbonate particles which are employed to provide the agglomerated matrix typically exhibit a surface area of less than about 1 m$^2$/g, as determined using the BET method. Typical binding materials are organic materials, such as cellulosic derivatives (e.g., sodium carboxymethylcellulose), and preferably are sugar containing materials, such as molasses, high fructose corn syrup, or Carob Powder Code 1739 from M. F. Neal, Inc. Preferably, a high solids content aqueous slurry of calcium carbonate and binding material is spray dried to provide agglomerated particles (e.g., normally spherical particles) of calcium carbonate particles and binding material. Alternatively, the slurry can be dried by the application of heat to provide a solid mass of agglomerated calcium carbonate and binding material, and the solid mass can be ground to yield particles of the desired size. Preferably, the amount of the calcium carbonate relative to binding material of ranges from 5:1 to about 20:1, more preferably about 10:1 to about 15:1, on a dry weight basis.

The agglomerated matrix of inorganic filler material and organic binding material is subjected to heat treatment. As such, volatile components from the organic binding material are expelled, and the organic binding material is calcined to form a water insoluble, carbonaceous material. Normally, the heat treatment of the agglomerated matrix is provided under controlled atmosphere, in order to minimize or prevent oxidation of the binding material. Preferably, the heat treatment provides a binding material which is carbonaceous, and in turn, provides a means for agglomerating the inorganic filler particles into a matrix form. In particular, the agglomerated calcium carbonate and binding agent particles can be heat-treated using an oven, a fluidized bed, rotary calciners, belt calciners, or the like. For example, spray dried calcium carbonate particles agglomerated using molasses can be heated in a fluidized bed having gaseous nitrogen heated at about 300° C. to about 425° C. flowing therethrough, and collected. After the calcining process, the agglomerated calcium carbonate particles normally have a calcium carbonate content of greater than about 90 weight percent. Normally, the resulting agglomerated particles are screened to sizes of about −100 to +325 US Mesh. Preferred agglomerated calcium carbonate particles which have been calcined are spherical in shape, are free flowing, and exhibit a bulk density of about 0.75 g/cm$^3$ to about 0.95 g/cm$^3$. As such, agglomerated calcium carbonate particles provide an inorganic filler material having a bulk density less than about 2 g/cm$^3$, and preferably less than about 1 g/cm$^3$, which includes an inorganic material having a bulk density greater than about 2.5 g/cm$^3$. Normally, such agglomerated calcium carbonate particles exhibit a surface area of less than about 15 m$^2$/g, and often less than about 10 m$^2$/g, as determined using the Brunaver, Emmett and Teller (BET) method described in *J. Am. Chem. Soc.*, Vol. 60, p. 309 (1938).

The components of the smokable material are provided as a slurry in an aqueous liquid. The manner for providing a slurry of the smokable material components in an aqueous liquid will be apparent to the skilled artisan. Typically, the slurry includes about 20 to about 90, preferably about 30 to about 70 percent combustible material; up to about 15, preferably up to about 10 percent binding agent; up to about 70, preferably up to about 60 percent inorganic filler material; and up to about 5, preferably up to about 3 percent tobacco extract; based on the total weight of those components of the slurry. Other materials, such as glycerin, cocoa, licorice and menthol, can be incorporated into the slurry. When the combustible material includes a relatively large proportion of combustible tobacco material, it is preferable that the components which are combined with the aqueous liquid to form the slurry incorporate a relatively high level of combustible material. For such a slurry, the weight of aqueous liquid relative to the weight of other components of the slurry normally is greater than about 4:1, and preferably ranges from 6:1 to about 10:1.

The slurry is contacted with the foaming agent. The foaming agent can be in a dry form or as a solution within an aqueous liquid. The manner of contact can vary; but it is highly preferable that the slurry be agitated at least while the foaming agent is added thereto. The slurry and foaming agent are agitated further, normally at a fairly high rate using a beater, mixer or high shear blender. The beater, mixer or blender can be equipped with knife-like mixer blades, beater blades, whisk beaters, or the like. Also useful is a mixing device available as Foam Generator Model OT10-3 from The Mearl Corp. If desired, air can be introduced into the slurry during agitation in order to enhance bubble formation within that slurry. Normally, the time period over which the slurry and foaming agent are agitated is relatively long if a relatively large proportion of the combustible material of the slurry is a combustible tobacco material. Typically, agitation of the slurry and foaming agent occurs for about 5 minutes to about 2 hours, normally for about 10 minutes to about 30 minutes.

The amount of foaming agent which is employed according to the process of the present invention can vary. However, the amount of foaming agent employed is quite small relative to the weight of the smokable material which ultimately is provided according to the process of the present invention. Typically, the amount of foaming agent (e.g., as surfactant and polymeric film-forming agent) employed is less than about 1 percent, preferably between about 0.001 percent and about 0.5 percent, based on the dry weight of the smokable material which ultimately is provided. When the foaming agent has the form of a surfactant, polymeric film-forming agent and liquid having an aqueous character, the weight of that forming agent within the slurry normally ranges from about 2 percent to about 10 percent, based on the total weight of the resulting slurry.

The slurry which has been contacted with the foaming agent and agitated has a decreased density relative to the slurry prior to the time that the foaming agent is contacted therewith. In particular, the slurry exhibits an overall increase in volume due to the formation of gas (e.g., air) bubbles therewithin. Of particular interest are gas bubbles which are relatively stable, and tend not to break up or be destroyed during normal handling of the slurry.

The slurry is formed into the desired shape. The manner in which the slurry is formed can vary. For example, the slurry can be extruded or molded into the desired shape. For slurries having components of suitably large size, a papermaking process can be used to provide a sheet of smokable material. Preferably, the slurry is cast as a sheet. It is highly desirable to cast the slurry as a sheet having a thickness of about 0.2 mm to about 0.6 mm, preferably about 0.3 mm to about 0.5 mm. Manners for casting a slurry will be apparent to the skilled artisan.

The formed slurry is dried to a desired or predetermined moisture level. The manner for drying the formed slurry can vary. For example, the cast slurry can be air dried under ambient conditions or heated on a heated metal surface. Preferably, conditions of airflow are minimized during drying operations in order to minimize destruction of gas bubbles within the formed slurry. Normally, the formed slurry is dried to a moisture level of about 1 to about 10, generally about 2 to about 8 weight percent.

The resulting smokable material most preferably has the form of filler (e.g., cut filler). As used herein, the terms "filler" or "cut filler" in referring to smokable materials are meant to include smokable materials which have a form suitable for use in the manufacture of smokable rods for cigarettes. As such, filler can include smokable materials which are blended and are in a form ready for cigarette manufacture. Smokable filler materials normally are employed in the form of strands or shreds as is common in cigarette manufacture. For example, cut filler material can be employed in the form of strands or shreds from sheet-like or "strip" materials. Such strip materials are cut into widths ranging from about 1/5 inch to about 1/60 inch, preferably from about 1/30 inch to about 1/40 inch. Generally, the resulting strands or shreds have lengths which range from about 0.25 inch to about 3 inches.

Flavoring agents can be incorporated into the smokable materials. In particular, the smokable materials can be cased and top dressed as is conventionally performed during various stages of cigarette manufacture. For example, flavoring agents can be applied to the smokable material as is commonly performed when cigarette cut filler is processed. Suitable flavoring agents include vanillin, cocoa, licorice, menthol, citric acid, malic acid, and the like. Flavor modifying agents, such as levulinic acid, can be applied to the smokable material (e.g., in amount ranging from about 0.01 to about 2 percent, normally from about 0.1 to about 1 percent, preferably about 0.2 to about 0.6 percent, based on the dry weight of the smokable material). Aerosol forming materials, such as glycerin and propylene glycol, can be applied to the smokable material. Such components conveniently are applied to the smokable material as casing and top dressing components.

A caramelizing material can be incorporated into the smokable materials. The caramelizing material conveniently can be incorporated into the smokable material by surface treating the smokable material after the smokable material has been manufactured. Normally, the amount of caramelizing material which is employed to treat a particular smokable material is such that the resulting smokable material which incorporates the caramelizing material includes about 5 to about 20 weight parts of caramelizing material and about 80 to about 95 weight parts of the smokable material which is treated. Examples of suitable caramelizing materials include sugars, such as glucose, fructose and sucrose; and compositions such as Carob Powder Code 1739 from M. F. Neal, Inc.

The previously described types of smokable materials can be blended with tobacco filler materials. Such tobacco filler materials can be provided in the form of tobacco laminae; volume expanded or puffed tobacco laminae; processed tobacco stems such as cut-rolled or cut-puffed stems; reconstituted tobacco materials, such as (i) a deproteinated tobacco material described in U.S. patent application Ser. No. 195,985, filed May 19, 1988, (ii) a phosphate-containing reconstituted tobacco material described in U.S. Pat. Nos. 3,353,541 and 3,420,241 to Hind et al, and 3,386,449 to Hind, or (iii) a reconstituted tobacco material described in *Tobacco Encyclopedia*, edited by Voges, p. 389, TJI (1984); or blends thereof.

The following examples are provided in order to further illustrate the invention but should not be construed as limiting the scope thereof. Unless otherwise noted, all parts and percentages are by weight.

EXAMPLE 1

A smokable material is provided as follows:

A carbonaceous material is provided by heating cotton linter fibers (i.e., non-tobacco material) having an alpha-cellulose content greater than 90 percent in a closed oven under nitrogen atmosphere. After about 2.5 hours of heating, the temperature in the oven reaches about 650° C. The temperature within the oven is held at about 650° C. for about 1 hour, while the atmosphere is maintained under nitrogen atmosphere. Then, the heating is ceased, and the temperature within the oven cools to ambient temperature in about 4 hours, while an atmosphere of nitrogen is maintained within the oven. The heated (i.e., pyrolyzed) cotton linter fibers are black in color, and have undergone a weight loss of about 80 percent. The pyrolyzed cotton fibers (i.e., carbonaceous material) have a carbon content of about 92 percent. Into a Waring Food Processor maintained at high shear mixing is charged about 12 g sodium carboxymethylcellulose available as 7HF from Hercules, Inc., about 36 g of the previously described carbonaceous material and about 72 g calcium carbonate particles screened at −40 to +200 U.S. Mesh. As such, a solid mixture of particulate material results. Then, into the Waring Food Processor is charged about 500 g distilled water at ambient temperature. The resulting mixture is sheared for about 5 minutes. The resulting slurry is an intimate mixture of the aforementioned components.

A foaming agent is provided by mixing about 40 g distilled water at about 40° C. with 0.144 g sodium lauryl sulfate and about 0.072 g methylcellulose available as Methocel A4M from The Dow Chemical Co.

The slurry is agitated using a nine speed Hamilton Beach Stand Mixer, Model No. 53, set at Speed 2, and the foaming agent is added to the slurry as agitation continues. Agitation is continued for about 15 minutes with the mixer set at Speed 8 in order to provide a slurry of decreased density.

The slurry then is cast as a sheet of about 0.5 mm thickness onto a polyethylene sheet. The resulting cast sheet is dried at ambient temperature for about 24 hours. The resulting sheet exhibits a moisture content of about 5 percent, a thickness of about 0.37 mm to about 0.42 mm, and a basis weight of about 110 g/m$^2$.

A sheet similarly prepared using similar components but not incorporating the foaming agent therein exhibits a thickness of about 0.45 mm to about 0.49 mm and a basis weight of about 195 g/m$^2$.

EXAMPLE 2

A smokable material is provided as follows:

Into a Waring Food Processor maintained at high shear mixing is charged about 36 g of the carbonaceous material described in Example 1, about 12 g of the sodium carboxymethylcellulose described in Example 1, and about 71 of the calcium carbonate described in Example 1. As such, a solid mixture of particulate material results. Then, into the Waring Food Processor is charged about 500 g distilled water at ambient temperature, and a well mixed slurry results after about 5 minutes of agitation. Into a portion of the slurry is incorporated about 1.2 g of a tobacco extract, and that portion is mixed back with the remaining portion of the slurry. The extract is provided using materials and process steps generally as set forth in Example 2 of European Patent Application No. 326370. The slurry is agitated for about 2 additional minutes.

The foaming agent is provided by mixing about 40 g distilled water at about 40° C. with about 0.144 g sodium lauryl sulfate and about 0.072 g of the methylcellulose described in Example 1.

The slurry is agitated using a nine speed Hamilton Beach Stand Mixer, Model No. 53, set at Speed 2, and the foaming agent is added to the slurry as agitation continues. Agitation then is continued for about 10 minutes with the mixer set at Speed 8 in order to provide a slurry of decreased density.

The slurry is cast as a sheet of about 0.5 mm thickness onto a polyethylene sheet. The resulting cast sheet is dried at ambient temperature for about 24 hours. The resulting sheet exhibits a mixture content of about 5 percent, a thickness of about 0.37 mm, and a basis weight of about 103 g/m$^2$.

A sheet similarly prepared using similar components but not incorporating the foaming agent therein exhibits a thickness of about 0.47 mm and a basis weight of about 223 g/m$^2$.

EXAMPLE 3

A smokable material is provided as follows:

Into a Waring Food Processor maintained at high shear mixing is charged about 6 g of the carbonaceous material described in Example 1, about 24 g of the calcium carbonate described in Example 1, about 4 g of the sodium carboxymethylcellulose described in Example 1, and about 6 g of an "American blend" of tobacco cut filler ground to a fine particle size by ball-milling the tobacco cut filler for about 1 hour. As such, a solid mixture of particulate material results. Then, into the Waring Food Processor is charged about 150 ml distilled water, and a well mixed slurry results in about 5 minutes.

The foaming agent is provided by mixing about 45 g distilled water, about 0.12 g sodium lauryl sulfate and about 0.06 g of the methylcellulose described in Example 1.

The slurry is agitated using a nine speed Hamilton Beach Stand Mixer, Model NO. 53, set at Speed 2, and the foaming agent is added to the slurry as agitation continues. Agitation then is continued for about 15 minutes with the mixer set at Speed 8 in order to provide a slurry of decreased density.

The slurry is cast as a sheet of about 0.5 mm thickness onto a polyethylene sheet. The resulting cast sheet is dried at ambient temperature for about 24 hours. The resulting sheet exhibits a moisture content of about 5 percent, a thickness of about 0.43 mm, and a basis weight of about 179 g/m$^2$.

A sheet similarly prepared using similar components but not incorporating the foaming agent therein exhibits a thickness of about 0.45 mm and a basis weight of about 202 g/m$^2$.

What is claimed is:

1. A process for providing a smokable material, the process comprising the steps of:

(a) providing a slurry of combustible material within an aqueous liquid, (b) contacting the slurry with a foaming agent which includes an intimate mixture of surfactant and polymeric film-forming agent, (c) subjecting the slurry and foaming agent to conditions sufficient to provide a slurry of decreased density, and (d) forming the slurry into a predetermined shape.

2. The process of claim 1 whereby the combustible material includes a carbonaceous material.

3. The process of claim 1 whereby the combustible material includes tobacco filler material and a carbonaceous material.

4. The process of claim 1, 2 or 3 whereby the slurry provided in step (a) includes a binding agent.

5. The process of claim 4 whereby the foaming agent includes about 50 to about 80 percent surfactant and about 20 to about 50 percent polymneric film-forming agent, based on the total weight of the surfactant and polymeric film-forming agent.

6. The process of claim 4 whereby the amount of foaming agent which is contacted with the slurry ranges between about 0.001 percent and about 0.5 percent, based on the dry weight of the smokable material so provided.

7. The process of claim 4 whereby the foaming agent includes an aqueous liquid.

8. The process of claim 1, 2 or 3 whereby the slurry provided in step (a) includes an inorganic filler material.

9. The process of claim 4 whereby the slurry provided in step (a) includes an inorganic filler material.

10. The process of claim 1 or 2 whereby the slurry provided in step (a) includes a tobacco extract.

11. The process of claim 4 whereby the slurry provided in step (a) includes a tobacco extract.

12. The process of claim 8 whereby the slurry provided in step (a) includes a tobacco extract.

13. The process of claim 1 whereby the foaming agent includes about 50 to about 80 percent surfactant and about 20 to about 50 percent polymeric film-forming agent, based on the total weight of the surfactant and polymeric film-forming agent.

14. The process of claim 13 whereby the slurry provided in step (a) includes an inorganic filler material and a binding agent.

15. The process of claim 1 or 13 whereby the surfactant includes sodium lauryl sulfate.

16. The process of claim 1 or 13 whereby the polymeric film-forming agent includes methylcellulose.

17. The process of claim 1 or 13 whereby the foaming agent includes an aqueous liquid.

18. The process of claim 1 or 13 whereby the amount of foaming agent which is contacted with the slurry ranges between about 0.001 percent and about 0.5 percent, based on the dry weight of the smokable material so provided.

19. The process of claim 18 whereby the slurry provided in step (a) includes an inorganic filler material and a binding agent.

20. The process of claim 1 whereby the slurry is formed into a sheet-like shape in step (d).

21. The process of claim 1 or 20 whereby the slurry which is formed into the desired shape is dried to a moisture level of about 1 weight percent to about 10 weight percent.

22. The process of claim 1 or 13 whereby the slurry is agitated at least during the period that the slurry is contacted with the foaming agent.

* * * * *